US008613415B1

(12) United States Patent
Selman et al.

(10) Patent No.: US 8,613,415 B1
(45) Date of Patent: Dec. 24, 2013

(54) DISH LIFTING DEVICE

(71) Applicant: Selman and Associates, Ltd., Midland, TX (US)

(72) Inventors: Thomas H. Selman, Midland, TX (US); Sean K. Crawford, Odessa, TX (US)

(73) Assignee: Selman and Associates, Ltd., Midland, TX (US)

( * ) Notice: Subject to any disclaimer, the term of this patent is extended or adjusted under 35 U.S.C. 154(b) by 0 days.

(21) Appl. No.: 13/850,902

(22) Filed: Mar. 26, 2013

Related U.S. Application Data

(60) Provisional application No. 61/704,224, filed on Sep. 21, 2012.

(51) Int. Cl.
*A47H 1/10* (2006.01)

(52) U.S. Cl.
USPC ... 248/325; 248/292.11; 248/235; 248/299.1; 343/872; 343/882

(58) Field of Classification Search
USPC ..... 248/235, 292.11, 292.13, 299.1, 326, 248/610, 611, 613, 631; 343/878, 880, 882, 343/890, 892, 898
See application file for complete search history.

(56) References Cited

U.S. PATENT DOCUMENTS

| | | | | |
|---|---|---|---|---|
| 4,509,711 | A * | 4/1985 | Wallther | 248/235 |
| 4,723,128 | A * | 2/1988 | Gasque, Jr. | 343/880 |
| 6,082,552 | A * | 7/2000 | Pollock et al. | 211/18 |
| 6,257,372 | B1 | 7/2001 | Schirmer | |
| 7,164,391 | B2 * | 1/2007 | Lin et al. | 343/882 |
| 7,225,933 | B1 * | 6/2007 | Pollock et al. | 211/18 |
| 7,527,282 | B2 | 5/2009 | Gilbert | |
| 8,141,851 | B2 | 3/2012 | Manev | |

* cited by examiner

*Primary Examiner* — Gwendolyn Baxter
(74) *Attorney, Agent, or Firm* — Buskop Law Group; Wendy Buskop

(57) ABSTRACT

A dish lifting device configured to secure to an object and support a communication dish. The dish lifting device can deploy a communication dish connected with a pivoting planar segment. The dish lifting device can stow the communication dish for transport.

4 Claims, 3 Drawing Sheets

DISH LIFTING DEVICE

CROSS REFERENCE TO RELATED APPLICATION

The current application claims priority to and the benefit of U.S. Provisional Patent Application Ser. No. 61/704,224 filed on Sep. 21, 2012, entitled "DISH LIFTING DEVICE". This reference is incorporated in its entirety.

FIELD

The present embodiments generally relate to lifts that raise and lower a communication dish for connecting with a satellite network.

BACKGROUND

A need exists for a stable collapsible device that can deploy a communication dish in the field next to an oil well being drilled while exposed to harsh artic conditions and subzero temperatures without collapsing.

A need exists for a stable collapsible device that can attach to a vehicle, stow a communication dish, and deploy the communication dish in an efficient manner.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The communication dish can be a self-aligning satellite dish, a manual satellite dish, or the like. The communication dish can be a TV satellite dish, a network dish, or the like. The communication dish can provide communication between one or more industrial automation devices, one or more well logging devices, one or more computing clouds, one or more networks, or combinations thereof.

This dish lifting device can efficiently deploy a communication dish adjacent an oil well.

The dish lifting device can provide for faster set up time. The dish lifting device can be moved to a stow position to protect the communication dish from high winds.

Figure 1:
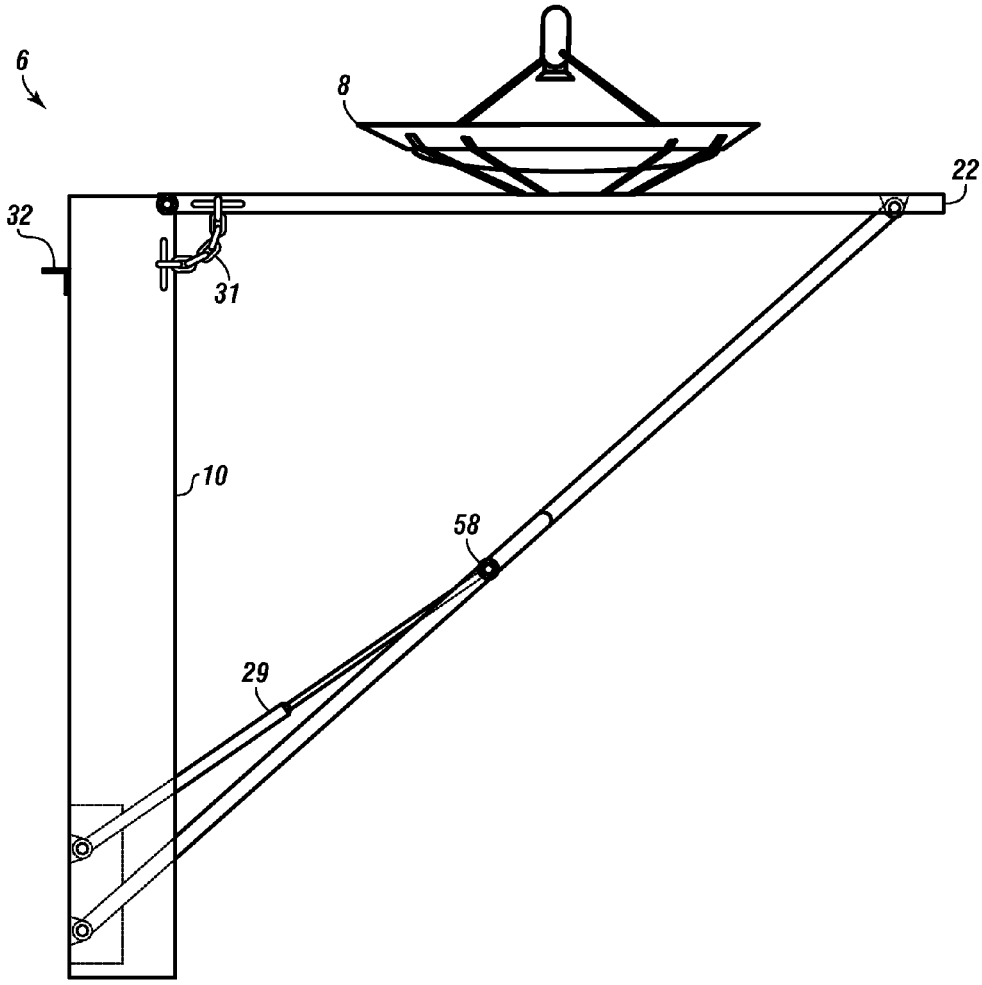
FIG. 1 depicts a side view of the dish lifting device.

Turning now to the Figures, FIG. 1 shows a side view of the dish lifting device.

The dish lifting device 6 can include a support member 10 and a pivoting planar segment 22.

A communication dish 8 can be connected with the pivoting planar segment 22.

The pivoting planar segment 22 can be made of any structurally sufficient material. Illustrative materials can include steel, alloys, composites, or the like.

The pivoting planar segment 22 can connect with the support member 10. The pivoting planar segment 22 can connect with a support member 10 by a connection that allows rotation of the pivoting planar segment 22. The pivoting planar segment 22 can be any shape. For example, the pivoting planer segment 22 can be square, rectangular, or the like.

The pivoting planar segment 22 can be a metal plate. The pivoting planar segment 22 can be sized as necessary to support the communication dish 8. The dimensions of the communication dish 8 can vary depending on the manufacture and the utility of the communication dish 8. The pivoting planar segment 22 can be customized in size to accommodate any communication dish 8.

For example, the pivoting planar segment 22 can have a length from about 10 inches to about 270 inches. The pivoting planar segment 22 can have a width from about 10 inches to about 270 inches. The pivoting planar segment 22 can have a thickness from about ¼ of an inch to about 40 inches.

The pivoting planar segment 22 can be coated with an insulation material. The insulation material can reduce static charge, electric conductivity, or the like. The insulation material can be urethane, rubber, fiberglass, or the like.

The pivoting planar segment 22 can support the communication dish 8. The communication dish 8 can be a manual communication dish or a self-aligning communication dish.

In one or more embodiments, the communication dish can adjust in three manners. The communication dish can rotate about 180 degrees to adjust inclination. The communication dish can rotate about 360 degrees to adjust the azimuth. The communication dish can have a radio that can rotate about 360 degrees to square with a transponder on a satellite.

An actuator rod 29 can be connected with a connection rod 58.

A safety chain 31 can be connected with the support member 10 and the pivoting planar segment 22.

A mounting bracket 32 can be connected with the support member 10. The mounting bracket 32 can secure to the top of an object, such as a vehicle, trailer, or other structure.

Figure 2:
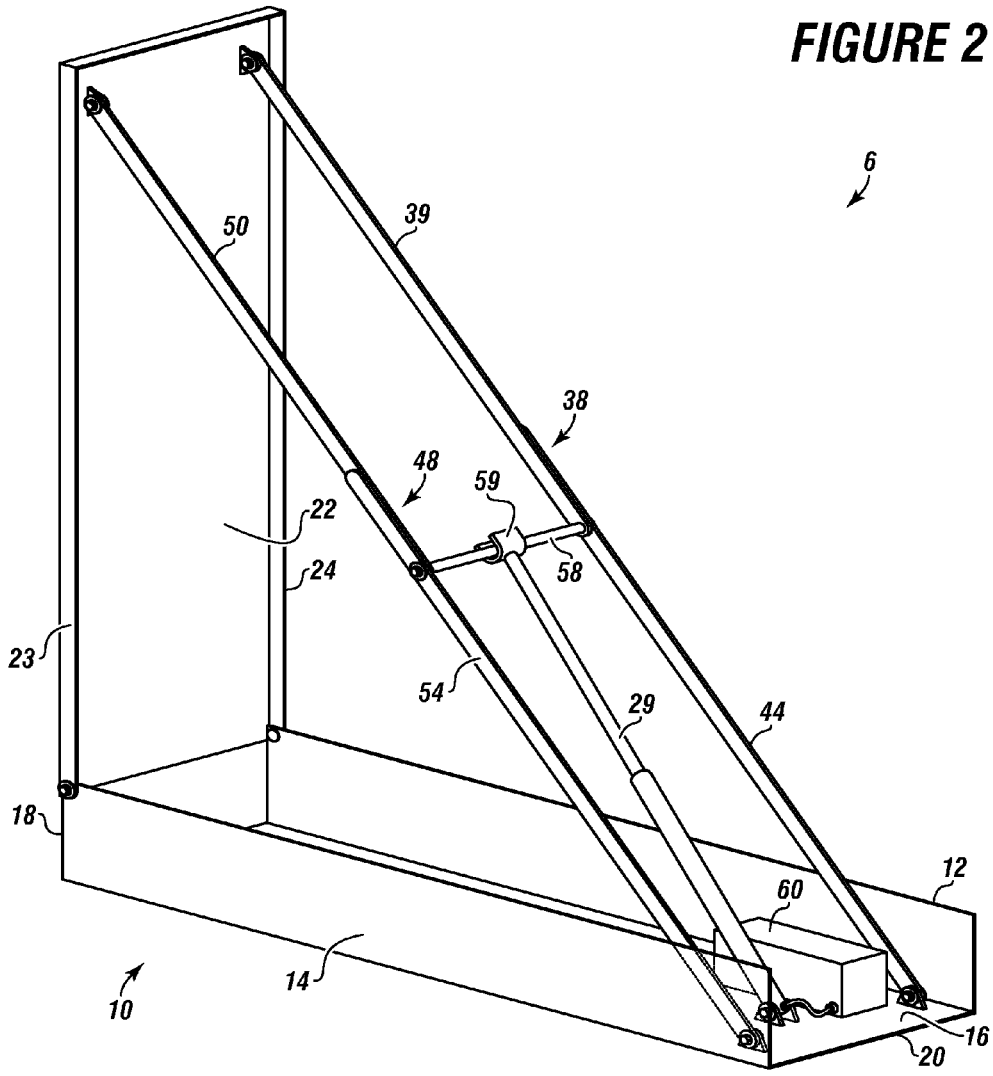
FIG. 2 depicts an isometric view of the dish lifting device.

FIG. 2 depicts an isometric view of the dish lifting device.

The support member 10 can have a first panel 12, a second panel 14, and a base 16.

The base 16 can connect with the first panel 12 and the second panel 14. The support member 10 can be formed from a single piece of material or can be formed by more than one piece.

The base 16, the first panel 12, and the second panel 14 can have one or more perforations formed therein. The perforations can be formed with laser milling or the like. The perforations can reduce the weight of the base 16, the first panel 12, and the second panel 14.

The support member 10 can be rectangular, square or another similar shape so long as the support member has a first end 18 and a second end 20.

The support member 10 and the pivoting planar segment 22 can be connected with one another. For example, the pivoting planer segment 22 can connect with the first panel 12 and the second panel 14 adjacent the first end 18.

A first leg 38 can connect with the pivoting planar segment 22 and the support member 10. The first leg 38 can have a first leg first section 39. The first leg first section 39 can connect with the inner surface of the pivoting planar segment 22, a first extension 24, or the like.

The first leg 38 can have a first leg second section 44. The first leg second section 44 can connect with the support member 10. The first leg second section 44 can connect with the inner surface of the support member 10, the first panel 12, or combinations thereof.

A second leg 48 can connect with the pivoting planar segment 22 and the support member 10. The second leg 48 can have a second leg first section 50. The second leg first section 50 can connect with the pivoting planar segment 22. The second leg first section 50 can connect with a second extension 23, the inner surface of the pivoting planer segment 22, or the like.

The second leg 48 can have a second leg second section 54. The second leg second section 54 can connect with a second panel 14, the inner surface of the support member 10, or the like.

The first leg 38 and the second leg 48 can be constructed of hollow profile tubular metal, providing increased strength and reduced weight. The first leg 38 and the second leg 48 can be connected with the support member using quick release pins.

The connection rod 58 can connect with the first leg 38 and the second leg 48. The length of the connection rod 58 can be less than the width of the base 16 of the support member 10. For example, the connection rod 58 can be 12 inches long, and the width of the base 16 can be 13.5 inches.

The connection rod 58 can connect with the actuator rod 29 using a U-bracket 59. The U-bracket 59 can be adjusted to provide an offset angle between the connection rod 58 and the actuator rod 29.

The actuator rod 29 can be driven by a driver 60. The driver 60 can be an electric motor or the like.

The connection rod 58 allows the first leg 38 and the second leg 48 to remain apart in a consistent and sturdy manner, at equal distances while the dish lifting device 6 unfolds.

One or more control panels can be connected with the dish lifting device 6. For example, a control panel can be connected with the first panel 12 adjacent the second end 20, and another control panel can be connected with the second panel 14 adjacent the second end 20, which will be described in FIG. 3.

Figure 3:
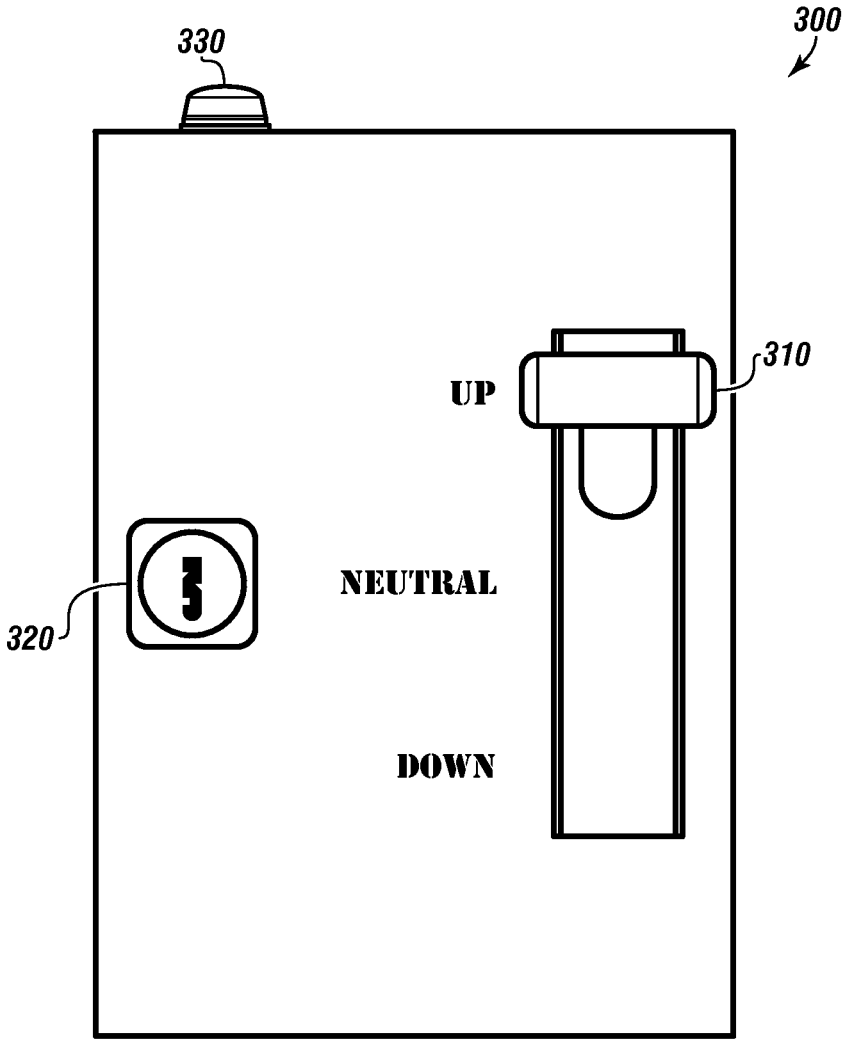
FIG. 3 depicts a control panel that can be connected with the dish lifting device.

FIG. 3 depicts a control panel that can be connected with the dish lifting device.

The control panel 300 can include a double through switch 310. The double through switch 310 can cut power when in a center location, actuate the drive to extend the actuator rod when moved to an up position, and actuate the drive to retract the actuator rod when in a down position.

The control panel 300 can include a lock out key 320. The lock out key 320 can allow a person to cut power to the double through switch 310. The lock out key 320 can receive a key that can allow the lock out key 320 to be placed in an on position or an off position. The lock out key 320 can provide an electrical path from a power source to the driver when in the on position, and the lock out key 320 can disconnect the electrical path from the power source to the driver when in the off position.

The power source can be an internal power source or an integrated power source. For example, the power source can be one or more batteries connected with the dish lifting device, one or more generators remote from the dish lifting device, one or more batteries remote from the dish lifting device, one or more photoelectric cells integrated with the dish lifting device, one or more photoelectric cells remote from the dish lifting device, or the like.

The control panel 300 can include an indicator light 330. The indicator light 330 can turn on to indicate that the lock out key 320 is in an on position.

While these embodiments have been described with emphasis on the embodiments, it should be understood that within the scope of the appended claims, the embodiments might be practiced other than as specifically described herein.

What is claimed is:

1. A dish lifting device comprising:

a. a communication dish;

b. a support member, wherein the support member comprises:

(i) a first panel;

(ii) a second panel; and (iii) a base connected with the first panel and the second panel, and wherein the support member provides a first end opposite a second end;

c. a pivoting planar segment mounted to the first end of the support member, wherein the communication dish is connected with the pivoting planar segment;

d. a first leg comprising:

(i) a first leg first section, wherein the first leg first section is connected with the pivoting planar segment; and (ii) a first leg second section, wherein the first leg second section is connected with the support member;

e. a second leg comprising:

(i) a second leg first section, wherein the second leg first section is connected with the pivoting planar segment; and (ii) a second leg second section, wherein the second leg second section is connected with the support member;

f. a connection rod connected with the first leg and the second leg, wherein a length of the connection rod is less than a width of the base, and wherein the first leg and the second leg remain apart at equal distances while the dish lifting device unfolds; and g. an actuator rod connected with the connection rod and the support member, wherein the actuator rod is configured to move the pivoting planar segment by providing force to the connection rod.

2. The dish lifting device of claim 1, wherein the first leg and the second leg are connected with the support member using quick release pins.

3. The dish lifting device of claim 1, wherein the pivoting planar segment is from 2 feet to 5 feet long and made from non-deforming steel at sub-arctic conditions.

4. The dish lifting device of claim 1, further comprising a safety chain connected with the support member and the pivoting planar segment.

* * * * *